US005086943A

United States Patent [19]

Poskie

[11] Patent Number: 5,086,943

[45] Date of Patent: Feb. 11, 1992

[54] SEALING CAP ASSEMBLY FOR AN ACCESS APERTURE

[75] Inventor: Fredrick R. Poskie, Plymouth, Mich.

[73] Assignee: General Motors Corporation, Detroit, Mich.

[21] Appl. No.: 709,464

[22] Filed: Jun. 3, 1991

[51] Int. Cl.[5] ..... B65D 51/16

[52] U.S. Cl. ..... 220/374; 220/373; 220/303; 33/727; 33/722; 33/730; 33/731

[58] Field of Search ..... 220/303, 374, 373, 367, 220/86.2, 86.1, DIG. 33, DIG. 32; 33/727, 728, 722, 730, 731

[56] References Cited

U.S. PATENT DOCUMENTS

| | | | |
|---|---|---|---|
| 1,047,517 | 12/1912 | Harris | 220/374 X |
| 2,562,604 | 7/1951 | Couchey | 220/373 X |
| 3,866,789 | 2/1975 | Lambert | 220/303 |
| 4,276,694 | 7/1981 | Richardson | 33/727 |
| 4,392,583 | 7/1983 | Wong | 220/202 |

*Primary Examiner*—Stephen Marcus

*Assistant Examiner*—Paul A. Schwarz

*Attorney, Agent, or Firm*—Donald F. Scherer

[57] ABSTRACT

The present invention is directed to a sealing cap assembly (10) of the type that is particularly adapted for use in closing and venting the access aperture (60) of a transmission housing (58). The embodiment of the sealing cap assembly (10) disclosed, has a body portion (15) and a cap portion (20). The body portion (15) has a radially outermost extent with at least one thread path (51 and/or 52) extending along, and being recessed inwardly with respect to, the outermost extent of the body portion (15). At least one hollow cubicle (46, 47, 48 or 49) is provided interiorly of the body portion (15). Port means (73 and/or 74) penetrate the body portion (15) in order to provide communication between at least one the thread paths (51 and/or 52) and the hollow cubicle (46, 47, 48 or 49). The cap portion (20) is attached to the body portion (15), but in spaced relation upwardly thereof, in order to provide communication between the hollow cubicle (46, 47, 48 or 49) and the environment to which the cap portion (20) is exposed.

10 Claims, 6 Drawing Sheets

FIG-4
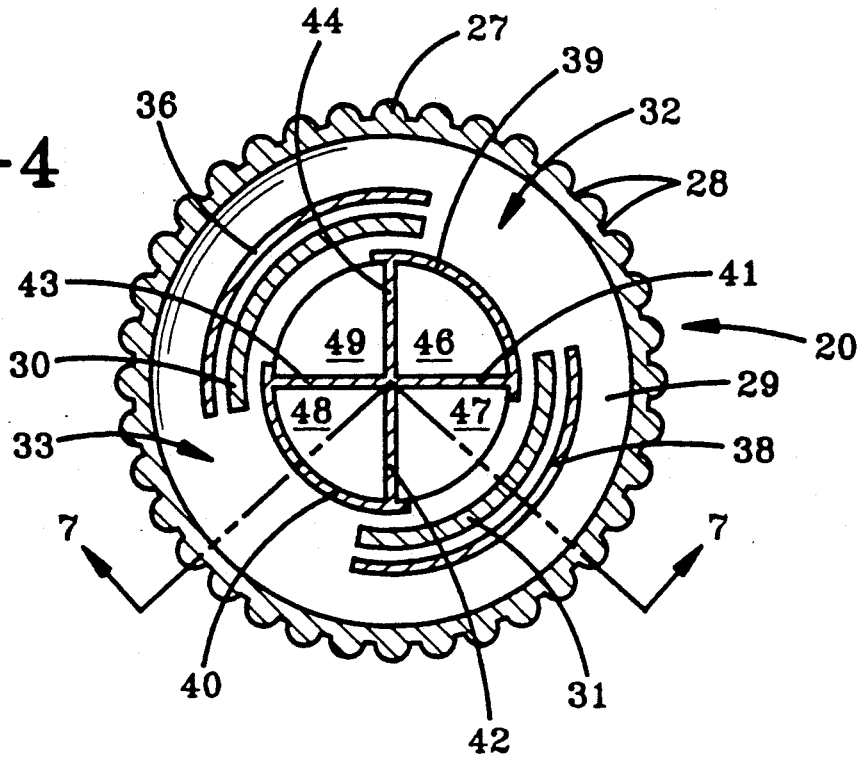
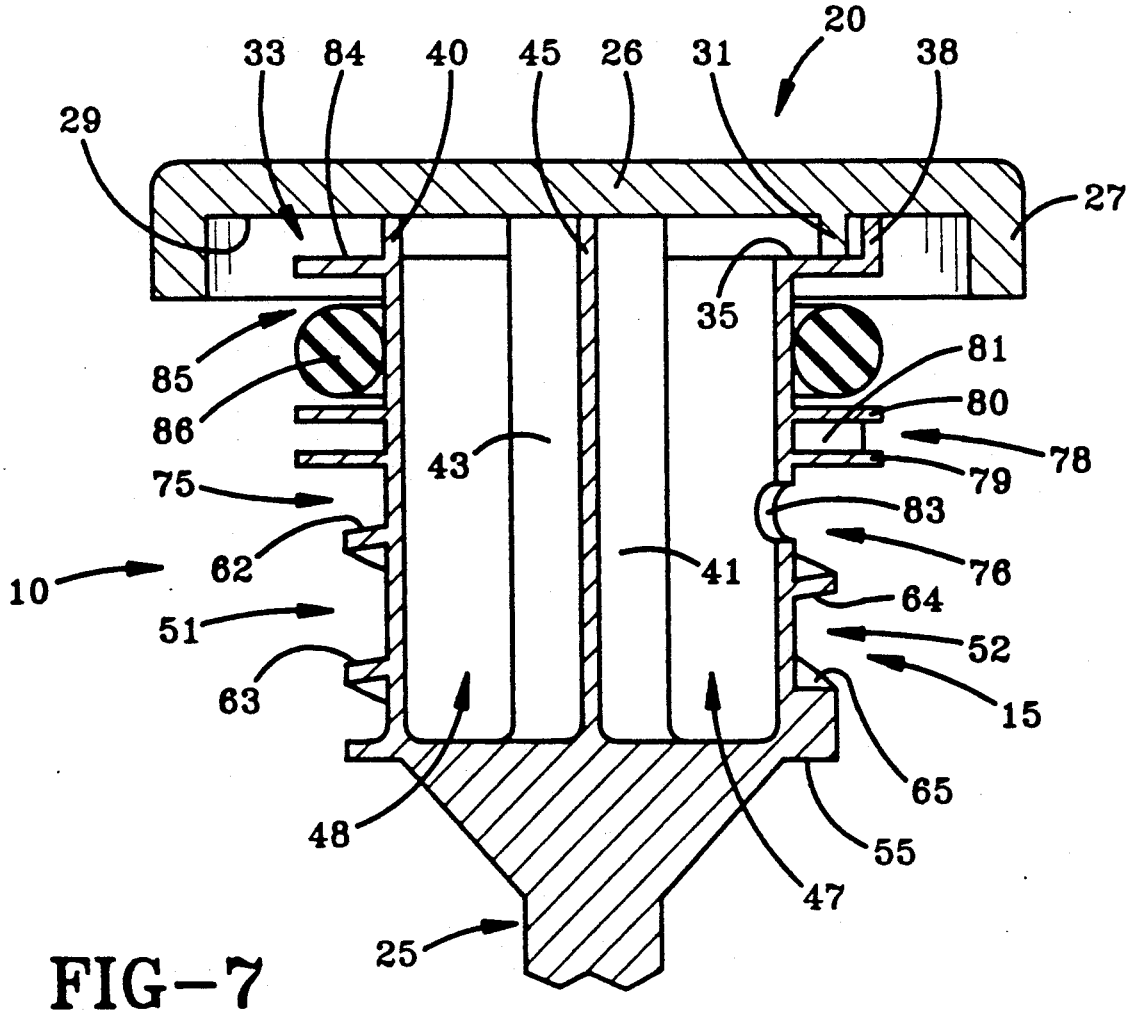
FIG-7

SEALING CAP ASSEMBLY FOR AN ACCESS APERTURE

TECHNICAL FIELD

The present invention relates generally to a venting arrangement associated with a sealing cap assembly adapted for cooperative interaction with an access aperture through which communication may be effected between the interior of a sealed housing and the surrounding atmosphere, such apertures being primarily used for the controlled admission of fluids, such as lubricants, into the housing.

More particularly, the present invention relates to a sealing cap assembly which cooperatively interacts with an access aperture that penetrates a sealed housing to provide a simplified means for uniquely venting pneumatic pressure therethrough, while precluding the entry of contaminants, either fluids or solids. Specifically, the present invention relates to a sealing cap assembly by which to effect venting of a sealed housing by an arrangement that is integrally incorporated within the sealing cap assembly and which cooperatively interacts with the interior of the access aperture within which it is received; a ullage rod may also be conveniently incorporated in the sealing cap assembly.

BACKGROUND OF THE INVENTION

There are a number of environments wherein a virtually closed vessel contains a fluid that is subjected to a wide range of temperature fluctuations. Such conditions can cause the fluid to expand or contract in response to those temperature variations, and simultaneously absorb or discharge gases. In order to accommodate these changes, such vessels are commonly provided with "breathing" vents which do accommodate pressure changes, but the historically known constructions for such breathing vents often permit the admission of contaminants from outside the vessel.

A transmission housing epitomizes a virtually closed vessel, and because of the intricate mechanism contained within a transmission housing, the presence of contaminants can be detrimental to the operation and maintenance of the transmission. As is well known in the art, transmission housings have heretofore been provided with rather intricate venting arrangements by which to equalize the pressures within the housing relative to the ambient pressure outside the housing, and at the same time attempt to preclude the admission of contaminants. Such prior known venting arrangements have required additional, intricate machining operations in order to prepare the housing for receiving the venting mechanism, and the venting mechanism has usually been separate from the access aperture or fill tube, and/or the cap by which the access aperture is selectively opened and closed. Historically, therefore, venting arrangements had to have been separately manufactured and installed.

The prior art is also replete with ullage rod arrangements which are separate from both the venting arrangement and the sealing cap for the fill tube. As a result, the production costs to make, install and maintain the aforesaid prior art arrangements unduly increased the costs of the transmission housing.

SUMMARY OF THE INVENTION

It is, therefore, a primary object of the present invention to provide an improved venting arrangement for use with closed vessels, and particularly those closed vessels in the nature of transmission housings.

It is another object of the present invention to provide a venting arrangement, as above, the major portion of which is incorporated in a sealing cap assembly that cooperatively interacts with the access aperture which communicates with the interior of the sealed vessel, the remaining portion of the venting arrangement being provided by that interaction.

It is a further object of the present invention to provide a venting arrangement, as above, that also precludes the admission of contaminants therethrough.

It is still another object of the present invention to provide a venting arrangement, as above, that can be manufactured, installed and maintained at a modest cost.

These and other objects of the invention, as well as the advantages thereof over existing and prior art forms, which will be apparent in view of the following detailed specification, are accomplished by means hereinafter described and claimed.

In general, a sealing cap assembly embodying the concepts of the present invention has a body portion and a cap portion. The body portion has a helical thread path means extending along, and being recessed inwardly with respect to the outermost extent of the body portion. At least one hollow cubicle is provided interiorly of the body portion. Port means penetrate the body portion in order to provide communication between the thread path means and the hollow cubicle. The cap portion is attached to the body portion, but in spaced relation upwardly thereof, in order to provide communication between the hollow cubicle and the environment to which the cap portion is exposed.

One exemplary sealing cap assembly, embodying the concepts of the present invention, is described herein in sufficient detail to effect a full disclosure of the subject invention. Although the sealing cap assembly is described in detail, it should be understood that the description does not attempt to show all of the various forms and modifications in which the invention might be embodied; the invention being measured by the appended claims and not by the details of the specification.

BRIEF DESCRIPTION OF THE DRAWINGS

FIG. 4 is a cross section taken substantially along line 4—4 of FIG. 2, but at slightly reduced dimensions, which depicts the relative disposition between the arcuate cap spacing segments extending downwardly from the cap portion relative not only to the arcuate body spacing segments extending upwardly from the body portion of the sealing cap assembly but also to the baffles extending upwardly from the body portion.

FIG. 7 is a slightly enlarged cross section through the body portion of the sealing cap assembly, as taken substantially along line 7—7 of FIG. 4, and appearing on the same sheet of drawings as FIG. 4.

DESCRIPTION OF AN EXEMPLARY EMBODIMENT

One representative form of a sealing cap assembly incorporating a venting arrangement which embodies the concepts of the present invention is designated generally by the numeral 10 on the accompanying drawings.

Figure 1:
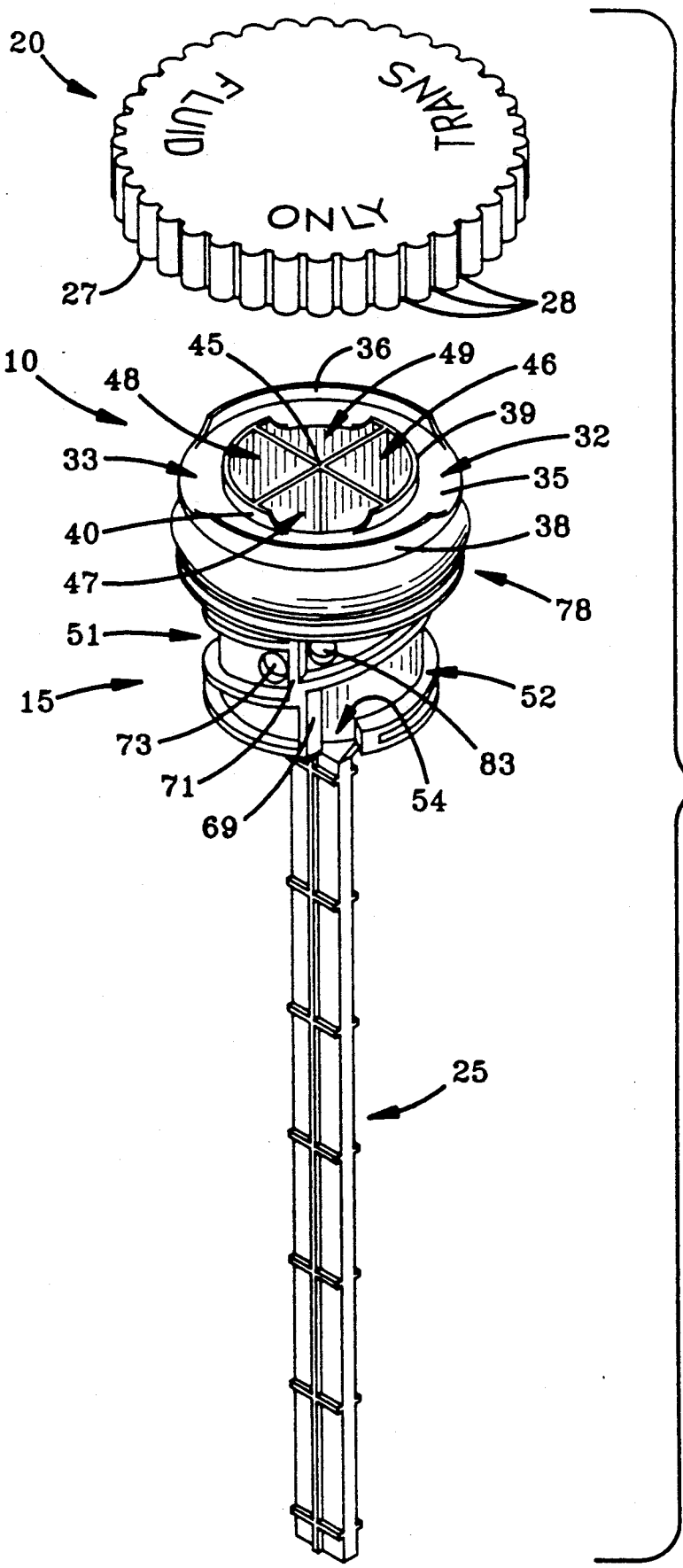
FIG. 1 is a perspective view of a sealing cap assembly embodying the concepts of the present invention, the assembly being exploded to depict the cap portion of the assembly separated from the body portion in order to facilitate viewing the top of the cubicle within the body portion.
Figure 2:
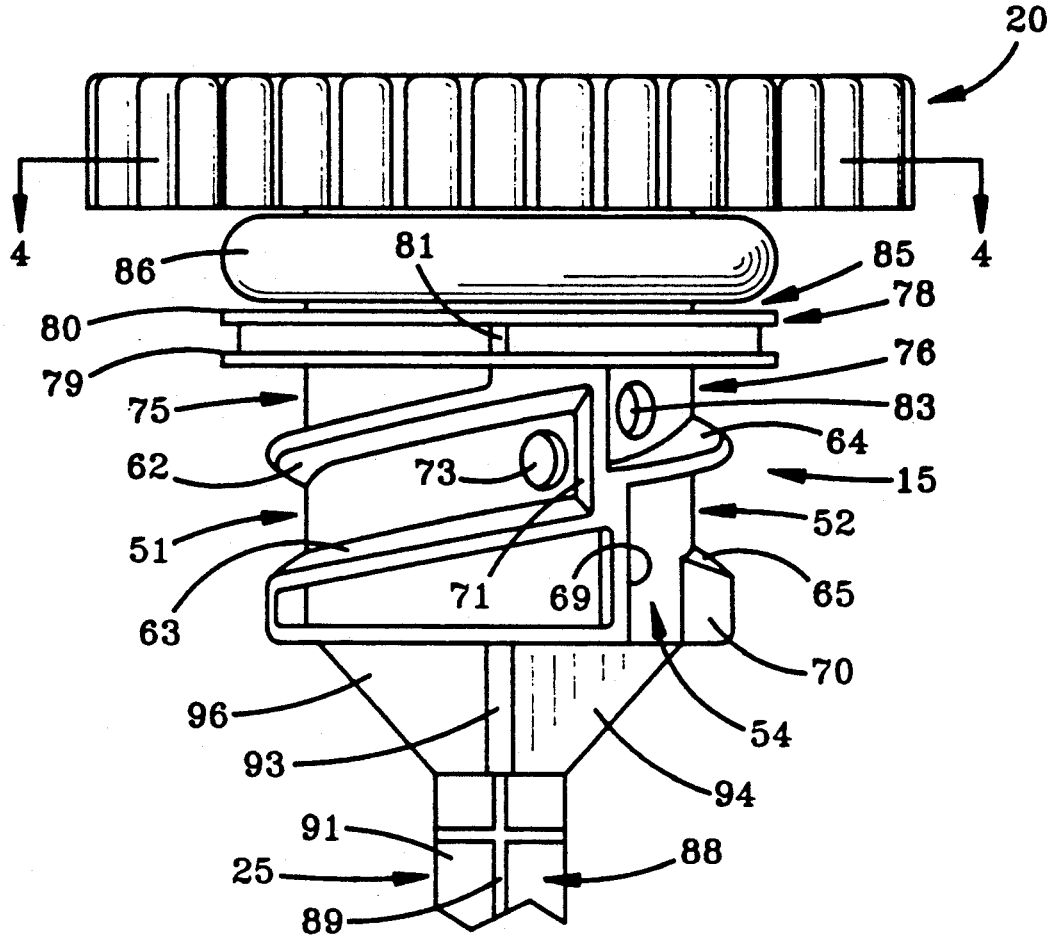
FIG. 2 is an enlarged, elevational view of the sealing cap assembly, and particularly the body and cap portions thereof, depicted in FIG. 1.
Figure 3:
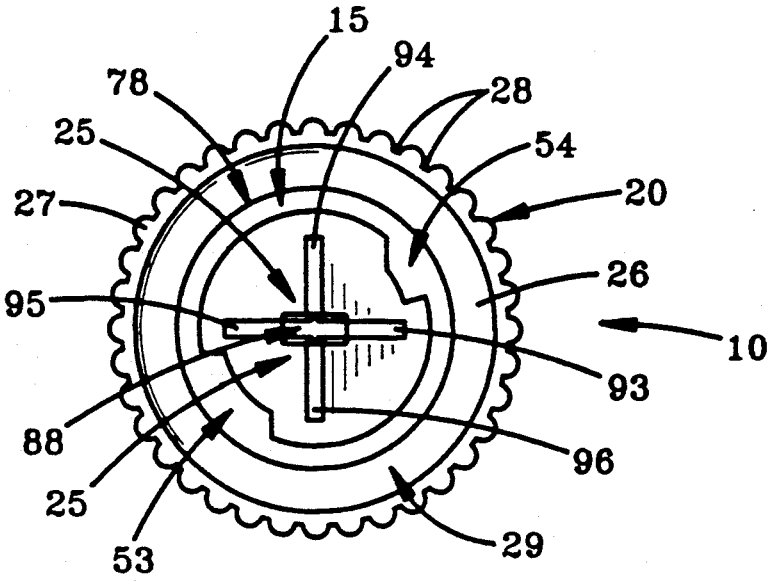
FIG. 3 is a bottom plan view, of modestly reduced dimensions, depicting the sealing cap assembly represented in FIGS. 1 and 2.
Figure 5:
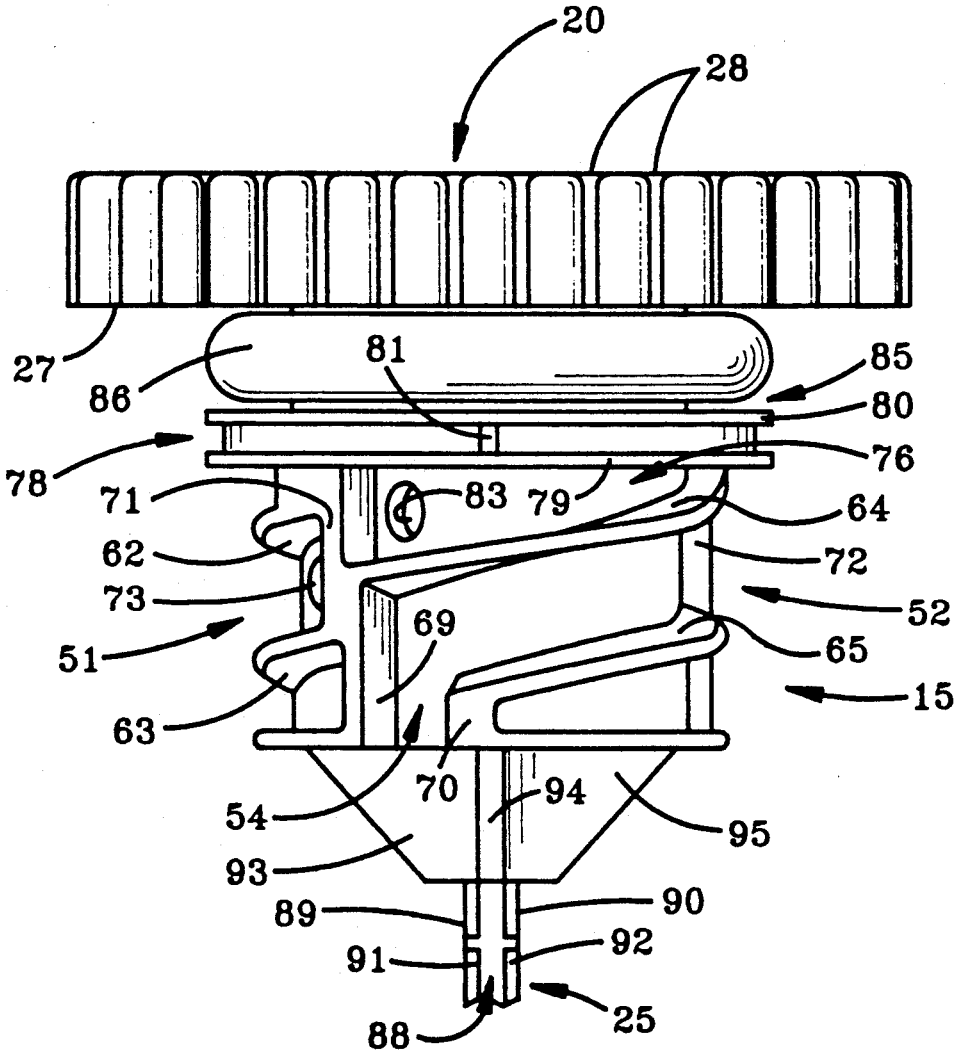
FIG. 5 is also an elevational view of the sealing cap assembly, as depicted in FIG. 2, but taken at approximately 90 degrees with respect to the orientation depicted in FIG. 2.
Figure 6:
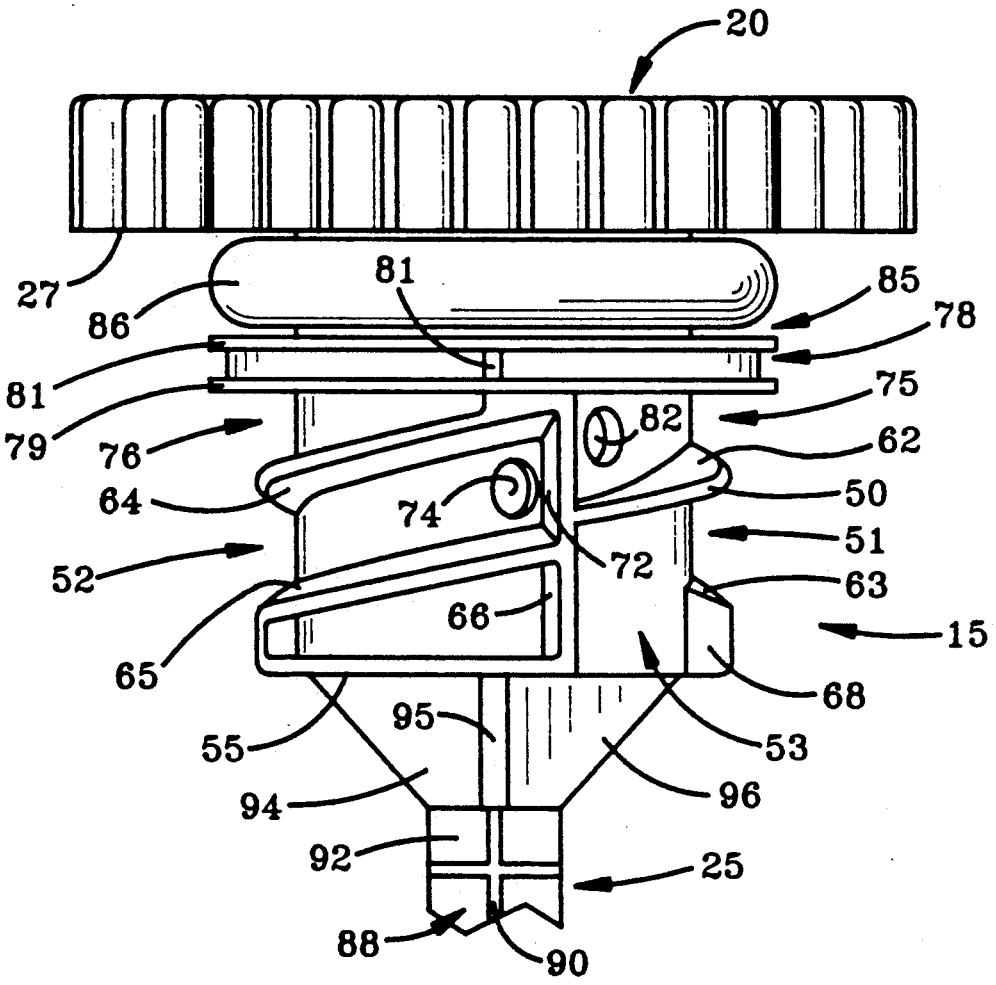
FIG. 6 is a further elevational view of the sealing cap assembly, as depicted in FIGS. 2 and 5, but taken at approximately 180 degrees with respect to the orientation of FIG. 2 and at approximately 90 degrees with respect to the orientation of FIG. 5.

With reference to FIG. 1, the cap assembly 10 has a body portion 15 to the upper end of which a cap portion 20 may be affixed and from the lower end of which a ullage rod 25 may extend axially downwardly. The cap portion 20 of the assembly 10 may have a flat top such as would be presented by a circular plate 26, and an annular skirt 27 extends downwardly from the periphery of the plate 26. The circumferential exterior surface of the skirt 27 may be axially fluted, as at 28, to complete the typical external appearance of the cap portion 20.

With reference also to FIG. 4, a first spacing means extends perpendicularly downwardly, as the cap portion is oriented in the drawings, from the undersurface 29 of the plate 26. The first spacing means is annularly discontinuous, resulting in arcuate, first and second cap spacing segments 30 and 31 which are disposed in diametric opposition. The discontinuity is defined by gaps 32 and 33 which, as will be explained, cooperate with the body portion 15 of the cap assembly 10 to comprise that portion of a maze-like passageway which extends between the body and cap portions 15 and 20, respectively.

Specifically, the body portion 15 has an annular configuration, the upper surface 35 of which is located in opposition to the cap spacing segments 30 and 31. In fact, when the sealing cap assembly 10 is fabricated, the spacing segments 30 and 31 will preferably engage, and may even be adhesively bonded to, the upper surface 35 of the body portion 15. Even with the cap spacing segments 30 and 31 bonded to the upper surface 35 on the body portion 15, the gaps 32 and 33 define a separation between the undersurface 29 on the cap portion 20 and the upper surface 35 on the body portion 15. The separation provided by the gaps 32 and 33 thereby define a portion of the maze-like passageway. The remainder of the maze-like passageway will also be hereinafter more fully described.

With reference to FIG. 1, a second spacing means extends perpendicularly upwardly from the upper surface 35 of the body portion 15. The second spacing means is also annularly discontinuous, resulting in arcuate, first and second body spacing segments 36 and 38. The body spacing segments 36 and 38 are preferably disposed concentrically outwardly of the cap spacing segments 30 and 31, as best seen in FIG. 4. The annular discontinuity of the body spacing segments 36 and 38 defines extensions of the gaps 32 and 33 so that the separation between the undersurface 29 and the upper surface 35 of the body portion 15 extends radially by virtue of the gaps 32 and 33 and their placement. The body spacing segments 36 and 38 may also be adhesively bonded to the undersurface 29 on the plate 26 to compound the integrity of the joinder between the cap portion 20 and the body portion 15.

A pair of first and second baffles 39 and 40 also extend upwardly from the inner periphery of the annular body portion 15 and are disposed in diametric opposition to each other. The arcuate, body spacing segments 36 and 38, which extend upwardly from the outer periphery of the annular body portion 15, are disposed in opposition to each other, but at approximately 90 degrees with respect to the opposed baffles 39 and 40.

The hollow interior of the annular body portion 15 is divided into quadrantal cubicles by partitioning divider walls. As depicted, the divider walls 41, 42, 43 and 44 may radiate outwardly from the central axis 45 of the annular body portion 15 in a cruciform disposition to divide the hollow cavity into the quadrantal cubicles 46, 47, 48 and 49. The opposed cubicles 46 and 48 are bounded by the baffles 39 and 40 which preferably tend to preclude communication between those cubicles 46 and 48 and that segment of the maze-like passageway which extends circumferentially between the vertically displaced upper surface 35 on the body portion 15 and the undersurface 29 on the cap portion 20 and between the radially inner baffles 39 and 40 and the radially outwardly disposed, arcuate, cap spacing segments 30 and 31 (and the concentrically outer, arcuate, body spacing segments 36 and 38). Because the baffles 39 and 40 do not extend along that portion of the annular body portion 15 which bounds the cubicles 47 and 49, those cubicles are in direct communication with, and also constitute a part of, the maze-like passageway.

Extending along the cylindrical outer surface 50 of the body portion 15 are first and second helical thread paths 51 and 52. Axially oriented lead-in grooves 53 and 54 communicate with the respective thread paths 51 and 52 and open axially past the base 55 of the cylindrical body portion 15. The lead-in grooves 53 and 54 may, if desired, be of different widths should one desire to provide some means by which to assure that the cap assembly 10 may only be received within the hereinafter described access aperture 60 penetrating a transmission housing 58 in a predetermined orientation.

The thread path 51 and 52 as well as the lead-in grooves 53 and 54 may be recessed within the outer surface 50 of the body portion 15 or they may, as shown, be delineated by side walls. Irrespective of which approach is employed to provide the thread paths, the thread paths may still be described as being recessed inwardly with respect to the radially outermost extent of the body portion 15. The radially outermost extent of the body portion 15 would be the circumferential outer surface 50 of the body portion 15, if the thread paths 51 and 52 were incised into the cylindrical outer surface 50 or, as shown, the radially outermost extent of the body portion 15 is the outermost extent of each of the hereinafter described side walls and end walls which delineate the thread paths 51 and 52. By either construction, the radially outermost extent of the body portion 15 is designed frictionally to engage the access aperture 60 so the thread paths 51 and 52 and, if necessary, the lead-in grooves 53 and 54 will constitute a portion of the maze-like passageway.

Figure 8:
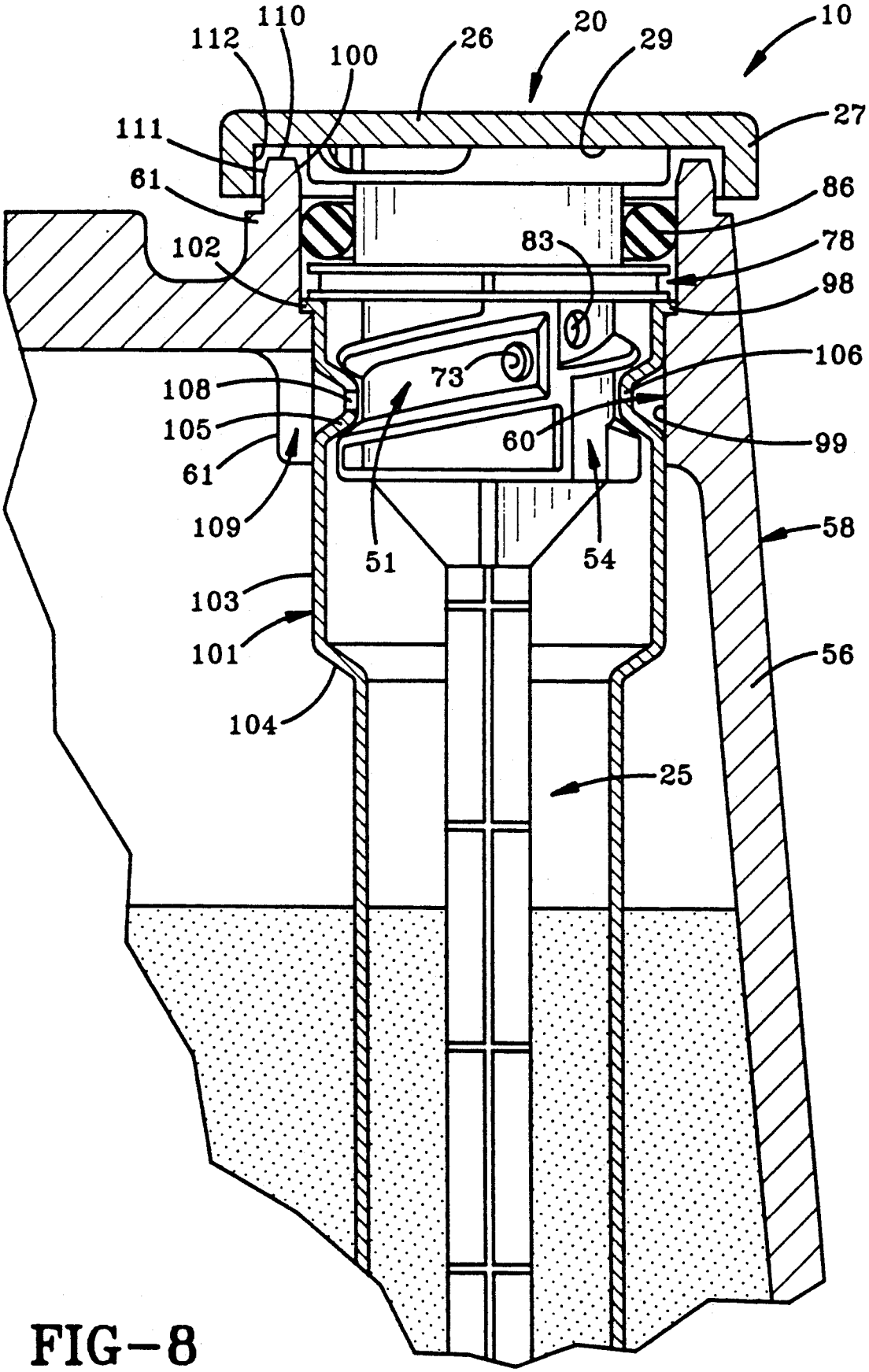
FIG. 8 is a vertical section through an access aperture associated with a vessel in the nature of a transmission housing which depicts the interaction between a sealing cap assembly embodying the concepts of the present invention and the access aperture, the sealing cap assembly being represented in side elevation.

To facilitate a complete understanding as to how the passageway is, in part, delineated by the interaction of the cap assembly 10 with the access aperture 60 within which it is to be received, reference may be made to FIG. 8. The wall 56 of a transmission housing 58 is provided with an access aperture 60 within which the sealing cap assembly 10 is operatively received. A boss 61 preferably circumscribes the aperture 60 in order to increase the axial extent of the access aperture 60. That enhancement in the axial dimension of the access aperture 60 assures that the sealing cap assembly 10 will interact with the boss 61 to a sufficient extent that the assembly 10 may be stabilized within the boss 61. The interaction between the sealing cap assembly 10 and the access aperture 60 also defines a portion of the venting arrangement, the remainder of which includes a maze-like passageway through the assembly 10 itself. The novel interaction between the sealing cap assembly 10 and the boss 61, as well as the maze-like passageway through the assembly 10, will both be more fully hereinafter explained.

Continuing with the description of the thread paths 51 and 52, as delineated by side walls which extend radially outwardly from the body portion 15, side walls 62 and 63 define the helical thread path 51, and side walls 64 and 65 define the helical thread path 52. Similarly, side walls 66 and 68 define lead-in groove 53, and side walls 69 and 70 define lead-in groove 54. As such, side wall 66 merges with the side wall 62 and side wall 68 merges with side wall 63 to delineate the continuous, but dog-leg, channel described by the first lead-in groove 53 and the first helical thread path 51. Likewise, side wall 69 merges with side wall 64 and side wall 70 merges with side wall 65 to delineate the continuous, but dog-leg, channel described by the second lead-in groove 54 and the second helical thread path 52.

Each of the aforesaid, helical thread paths 51 and 52 extend through approximately one-half the circumference of the outer surface 50 to terminate at end walls 71 and 72, respectively. The end walls 71 and 72 for each thread path 51 and 52, respectively, may be disposed in substantial axial alignment with the side walls 69 and 66 of the lead-in groove 54 and 53 for the other thread path 52 or 51, respectively, as shown. However, if one elects to extend the thread paths 51 and 52 through more than one-half of the circumference of the outer surface 50, the thread paths may be contiguously juxtaposed through at least a part of their helical paths, in which case the end walls 71 and 72 would likely not be axially aligned with the side walls 69 and 66 of either lead-in groove 54 or 53.

In any event, primary communication ports 73 and 74 penetrate the body portion 15 to effect a flow passage between the thread paths 51 and 52 and the respective cubicles 47 and 49 which constitute a portion of the maze-like passageway. As such, the primary communication ports 73 and 74, as well as the thread paths 51 and 52 and their respective lead-in grooves 53 and 54, are also included in the maze-like passageway of the venting arrangement incorporated within the sealing cap assembly 10.

The use of side walls 62 and 64 to define the axially uppermost edge of the helical thread paths 51 and 52 creates a pair of recesses 75 and 76 between the side-walls 62 and 64 and a first radially extending composite flange assembly 78 which circumscribes the body portion 15 at the axially uppermost extent of the helical thread paths 51 and 52. To combine strength with lightness of weight, the flange assembly 78 may be compositely formed as a pair of relatively closely spaced, radially extending, individual flanges 79 and 80 interconnected by a plurality of axially disposed bracing ribs 81. A pair of secondary communication ports 82 and 83 may also penetrate the body portion 15 to effect a flow passage between each recess 75 and 76 and the cubicles 47 and 49 of the maze-like passageway. By that approach, any pneumatic pressure within the recesses 75 or 76 would be vented into the cubicles 47 and 49, and thus into the maze-like passageway.

A second radially extending flange 84 (FIG. 7) also circumscribes the body portion 15 of the sealing cap assembly 10. The upper surface of the second radial flange 84 is coplanar, merges with, and constitutes a portion of, the upper surface 35 on the body portion 16. In addition, the second flange 84 is disposed in axially spaced relation upwardly of said first radial flange assembly 78 to define an annular groove 85 therebetween which also circumscribes the body portion 15 of the cap sealing assembly 10. A sealing means 86, which may be in the form of the O-ring depicted, is received within the annular groove 85.

To complete the description of the sealing cap assembly 10, the ullage rod 25 extends downwardly from the base 55 of the body portion 15. The ullage rod 25 comprises a relatively thin, rectangular portion 88 with longitudinal, central ridges 89 and 90 extending axially along each of the relatively wide face surfaces 91 and 92. The rectangular portion 88 of the ullage rod 25 may be integral with the base 55 and be reinforced by a plurality of haunched, strengthening flanges 93, 94, 95 and 96 which extend between the rectangular portion 88 and the base 55 of the body portion 15.

To mount the sealing cap assembly 10 within an access aperture 60, the aperture 60 is preferably provided with an annular stop ledge 98 (FIG. 8) against which the flange assembly 78 will bottom when the sealing cap assembly 10 is properly seated within the aperture 60. That portion of the interior surface 99 of the aperture 60 which extends upwardly from the stop ledge 98 is preferably flared, as at 100, to facilitate entry of the sealing means 86 into the aperture 60 and to effect progressive sealing compression for the sealing means 86 against the interior surface 99.

A tubular splash baffle 101 may also be supported from the stop ledge 98. Specifically, a mounting lip 102 may extend radially outwardly from the hollow, cylindrical portion 103 (which may be stepped, as at 104) of the tube-like splash baffle 101, and the lip 102 may be received o the stop ledge 98 in order to fixedly support the splash baffle 101 in the position depicted.

A pair of thread engaging protuberances 105 and 106 is provided which may slide axially along the lead-in grooves 53 and 54 to be engaged by the thread paths 51 and 52 and along which the thread paths may helically slide. If no splash baffle 101 is employed, the protuberances 105 and 106 may extend radially inwardly from the interior surface 99 of the aperture 60. On the other hand, if a tubular splash baffle 101 is employed, as shown, the protuberances 105 and 106 may be presented from the tubular portion 103 of the splash baffle 101, as by dimpling the tubular portion 103 at appropriate locations. When the splash baffle 101 is employed, a port 108 penetrates the dimpled protuberance 105. The port 108 is preferably aligned with a notch 109 in the boss 61, which facilitates communication between the interior of the housing 58 and at least one of the thread paths 51 or 52 (thread path 51, as shown).

In operation, the sealing cap assembly 10 is inserted into the access aperture 60 of the transmission housing 58, such that the thread engaging protuberances 105 and 106 align with the respective lead-in grooves 53 and 54. When the protuberances 105 and 106 are thus aligned with the lead-in grooves 53 and 54, the sealing cap assembly 10 is translated axially until the cap assembly 10 may be rotated, such that the protuberances 105 and 106 will follow along the helical trace of the thread paths 51 and 52 by engagement of the protuberances 105 and 106 with the respective sidewalls 62 and 63 of the thread path 51 and the side walls 64 and 65 of the thread path 52.

Continued rotation of the cap sealing assembly 10 forces the flange assembly 78 against the stop ledge 98 and drives the protuberances 105 and 106 against the respective side walls 63 and 64 to secure the cap assembly 10 axially within the access aperture 60. With the sealing cap assembly 10 so secured within the access aperture 60, the sealing means 86 engages the flared portion 100 on the interior surface 99 of the access aperture 60 to seal the transmission housing 58. As shown in FIG. 8, however, even when the cap sealing assembly 10 is so secured within the access aperture 60, the portion of the boss 61 which extends upwardly from the housing 58 has an upper surface 110 that remains in vertically spaced relation beneath the undersurface 29 of the cap portion 20, and has an outer, cylindrical surface 111 that remains in radially spaced relation inwardly of the cylindrical inner surface 112 on the skirt 27 on the cap portion 20.

The venting arrangement provided by the sealing cap assembly 10, as well as the interaction of the cap sealing assembly 10 and the access aperture 60, effects communication between the interior of the transmission housing 58 and the environment, as follows. Assuming that the pressure of the gasses within the transmission housing 58 increases beyond the pressure of the environmental atmosphere, and assuming that a splash baffle 101 is employed, the majority of the gasses which are effecting the pressurization of the housing 58 will pass through the notch 109 in the boss 61 and penetrates the port 108 in the protuberance 105 to gain access to the thread path 51. Any excess pressure within the thread path 51 will be relieved through the communication port 73 to enter quadrantal cubicle 47.

From the cubicle 47, the gas will flow outwardly of the cubicle 47 into that portion of the maze-like passage defined not only by the vertically opposed and displaced surface 29 and 35, but also by the baffles 39 and 40 which are radially spaced relative to the spacing segments 38 and 39. After flowing partially circumferentially, the gas will then flow radially outwardly through the gaps 32 and 33 to pass between the upper surface 110 on the boss 61 and the undersurface 29 of the cap portion 20, and then axially between the outer surface 111 on the boss 61 and the inner surface 112 on the skirt 27.

In the situation where the pressure within the housing 58 falls below the ambient pressure exteriorly of the housing 58, the flow of air would follow a reverse path.

The maze-like passageway defined above will freely permit the passage of air or other gases between the interior of the housing 58 and the surrounding atmosphere, and vice versa, without permitting the admission of solid or liquid contaminants into the housing 58, and without permitting the escape of fluid from within the housing 58.

It should be appreciated that for some installations, the same results may well be achieved even without the use of a splash baffle 101. In that situation, the notch 109 could be eliminated and gasses within the housing 58 would pass along the lead-in grooves 53 and 54 to gain admission to the thread paths 51 and 52 and then flow through the communicating ports 73 and 74 and into the quadrantal cubicles 47 and 49. The flow outwardly from the cubicle 49 is accomplished in the same manner as the flow outwardly from the cubicle 47. Hence, irrespective of whether or not a splash baffle 101 is utilized, the sealing cap assembly 10 itself, and the cooperative interaction between the sealing cap assembly 10 and the access aperture 60, will still permit the venting arrangement which precludes the admission of contaminants and the escape of fluids from the housing 58.

The judicious placement of the primary communicating ports 73 and 74, as well as the secondary communicating ports 82 and 83, will assure that any pressure differential between the interior and the exterior of the housing 58 will be equalized by access to the cubicles 47 and 49. Thus, a sealing cap assembly embodying the concepts of the present invention fully accomplishes all the objects of the invention.

The embodiments of the invention in which an exclusive property or privilege is claimed are defined as follows:

1. A sealing cap assembly comprising: a body portion having a radially outermost extent; thread path means extending along, and being recessed inwardly with respect to, the radially outermost extent of said body portion; at least one hollow chamber provided interiorly of said body portion; port means penetrating said body portion in the location of said thread path means recess, to provide communication between said thread path means and said hollow chamber; a cap portion attached to said body portion, and being disposed in spaced relation with respect thereto in order to provide communication between said hollow chamber and the environment to which said cap portion is exposed.

2. A sealing cap assembly, as set forth in claim 1, wherein: spacing means extend between said body portion and said cap portion to determine the magnitude of the spaced relation therebetween and also to delineate a path by which communication may be effected between said chamber and the environment to which said cap portion is exposed.

3. A sealing cap assembly, as set forth in claim 2, wherein: said body portion is substantially cylindrical; said thread path means is at least one helically disposed thread path; and said spacing means extending between said body portion and said cap portion spaces said cap portion upwardly of said body portion and thereby provide communication between said hollow cubicle means and the environment to which said cap portion is exposed.

4. A sealing cap assembly, as set forth in claim 3, wherein: said at least one helically disposed thread path further includes a pair of helical thread paths at least partially circumscribing said body portion.

5. A sealing cap assembly, as set forth in claim 4, wherein: a lead-in groove extends axially along said radially outermost extent to intersect each said thread path whereby said thread paths open downwardly along said body portion.

6. A sealing cap assembly, as set forth in claim 5, wherein: said lead-in paths have different circumferential dimensions.

7. A sealing cap assembly in combination with an access aperture through a wall of a transmission housing, said combination comprising: a boss substantially circumscribing said access aperture; a stop ledge presented interiorly of said boss; engaging protuberances extending inwardly with respect to said boss; said sealing cap assembly having a body portion with a radially outermost extent; thread path means extending along, and being recessed inwardly with respect to, the radially outermost extent of said body portion; at least one hollow cubicle provided interiorly of said body portion; port means penetrating said body portion in the location of said thread path means recess to provide communication between said threaded path means and said hollow cubicle; a cap portion attached to said body portion, and being disposed in spaced relation with respect thereto in order to provide communication between said hollow cubicle and the environment to which said cap portion is exposed; spacing means extending between said body portion and said cap portion to determine the magnitude of the spaced relation therebetween and also to delineate a path by which communication may be effected between said cubicle and the environment to which said cap portion is exposed.

8. A sealing cap assembly in combination with an access aperture for a housing: a boss circumscribing the access aperture; said boss having an upper surface, a flared inner surface and a cylindrical outer surface; a stop ledge presented from the interior of said boss; engaging protuberances extending inwardly with respect to said boss; the sealing cap assembly having a body portion and a cap portion; said body portion having radially outermost extent; thread path means extending along, and being recessed inwardly with respect to, the radially outermost extent of said body portion to interact with said engaging protuberances; at least one hollow cubicle provided interiorly of said body portion; port means penetrating said body portion in the location of said thread path means recess to provide communication between said threaded path means and said hollow cubicle; sealing means presented from the exterior of said body portion to interact with the flared surface of said access aperture; flange means also being presented from said body portion to interact with said stop ledge; a cap portion; said cap portion having a circular plate circumscribed by an annular skirt; spacing means; said spacing means extending between said plate and said body portion to define a spaced relation therebetween in order to provide a portion of a maze-like passageway interposed between said body portion and said cap portion; said spacing means and the interaction between said flange means and said stop ledge combining to effect that portion of a maze-like passageway extending radially between the upper surface on said boss and the plate of said cap portion; and, said skirt being disposed radially outwardly from the outer surface of said boss to effect that portion of a maze-like passageway extending axially between the outer surface on said boss and the skirt of said cap portion.

9. A combination, as set forth in claim 8, wherein: said at least one cubicle presents quadrantal cubicles; at least two of said cubicles communicating with said maze-like passageway; baffle means interposed between the other two said cubicles and the maze-like passageway to restrict communication therebetween.

10. A combination, as set forth in claim 9, further comprising: a splash baffle; said splash baffle having a tubular portion and a radially extending, mounting lip; said engaging protuberances extending radially inwardly from said tubular portion; a notch in said boss; at least one of said engaging protuberances having a port therethrough; said port aligning with said notch; said mounting lip interacting with said stop ledge to determine the extent to which said splash baffle can extend into said access aperture; and, said spacing means and the interaction between said flange means, said mounting lip and said stop ledge combining to effect that portion of said maze-like passageway extending radially between the upper surface on said boss and the plate of said cap portion.

* * * * *